US010351988B2

(12) United States Patent
Mora et al.

(10) Patent No.: US 10,351,988 B2
(45) Date of Patent: Jul. 16, 2019

(54) WASHING MACHINE APPLIANCE AND LID ASSEMBLY

(71) Applicant: Haier US Appliance Solutions, Inc., Wilmington, DE (US)

(72) Inventors: Adam Raymond Mora, La Grange, KY (US); Michael Wuttikorn Ekbundit, Mount Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 600 days.

(21) Appl. No.: 15/207,535

(22) Filed: Jul. 12, 2016

(65) Prior Publication Data

US 2018/0016729 A1 Jan. 18, 2018

(51) Int. Cl.
*D06F 39/14* (2006.01)
*D06F 23/04* (2006.01)

(52) U.S. Cl.
CPC ..... *D06F 39/14* (2013.01); *D06F 23/04* (2013.01)

(58) Field of Classification Search
None
See application file for complete search history.

(56) References Cited

U.S. PATENT DOCUMENTS 8,250,706 B2 8/2012 Vanini
2006/0053589 A1* 3/2006 Vanini ..... E05D 13/123 16/286

FOREIGN PATENT DOCUMENTS

DE 2347871 A1 4/1975
WO WO2013170466 A1 11/2013

* cited by examiner

*Primary Examiner* — Michael E Barr
*Assistant Examiner* — Jason P Riggleman
(74) *Attorney, Agent, or Firm* — Dority & Manning, P.A.

(57) ABSTRACT

A washing machine appliance and lid assembly is provided. The appliance may include a cabinet defining an opening, a basket, a door, a balance lever, and a counter balance assembly. The door may be pivotable about a pivot axis between an open position and a closed position. The counter balance assembly may be mounted to the balance lever to hold the door in an intermediate position between the open position and the closed position. The counter balance assembly may include a guide pin coupled to the balance lever and a bracket coupled to the cabinet and defining a trailing surface. The guide pin may be slidably disposed on the trailing surface of the bracket.

20 Claims, 7 Drawing Sheets

WASHING MACHINE APPLIANCE AND LID ASSEMBLY

FIELD OF THE INVENTION

The present subject matter relates generally to appliance lid assemblies and more particularly to lid assemblies for washing machine appliances.

BACKGROUND OF THE INVENTION

Washing machine appliances generally include a cabinet having a tub for containing wash fluid, e.g., water and detergent, bleach, and/or other fluid additives. A basket is rotatably mounted or positioned within the tub and defines a wash chamber for receipt of articles for washing. During operation of such washing machine appliances, wash fluid is directed into the tub and onto articles within the wash chamber of the basket. The basket and/or an agitation element can rotate at various speeds to, e.g., agitate articles within the wash chamber, wring wash fluid from articles within the wash chamber, etc.

A lid assembly is generally provided to allow a user to selectively access the wash chamber of the basket, such as in a vertical-access washing machine appliance. The lid assembly may be movable between an open position, wherein a user can add or remove clothes from the wash chamber, and a closed position, wherein the washing machine appliance may be operable to wash the clothes or other articles positioned within the wash chamber.

Although the lid assembly of existing configurations may generally move between an open and closed position, conditions may arise wherein neither position is desirable. For instance, user may wish to load or monitor the wash chamber of the basket without moving the lid assembly all the way into the open position, such as when the necessary clearance or space for the open position is not available. If the user's hands are otherwise occupied, existing systems may be unable to hold or maintain the lid assembly in a position that is in between the closed position and the open position. In addition, even when a user does wish to use the lid assembly in the open position, the user may wish to prevent a sudden undesired movement from the open position to the closed position, such as when the lid assembly slams shut.

Accordingly, an appliance with a door that includes features for maintaining the door in an intermediate position, as well as closed and open position may be desirable. More particularly, a washing machine that has one or more features for selectively holding its lid assembly in an intermediate position would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, an appliance is provided. The appliance may include a cabinet defining an opening, a basket, a door, a balance lever, and a counter balance assembly. The basket may be positioned within the cabinet and define a wash chamber beneath the opening of the cabinet. The door may define a pivot axis and be pivotally attached to the cabinet. The door may further be pivotable about the pivot axis between an open position and a closed position. The balance lever may be fixed to the door and extending in a radial direction away from the pivot axis to a distal end. The counter balance assembly may be mounted to the balance lever to hold the door in an intermediate position between the open position and the closed position. The counter balance assembly may include a guide pin coupled to the balance lever, the guide pin being spaced apart from the pivot axis in the radial direction, and a bracket coupled to the cabinet and defining a trailing surface. The guide pin may be slidably disposed on the trailing surface of the bracket. The trailing surface may include a first projection and a second projection spaced apart from the first projection to define a detent recess therebetween. The guide pin may be received within the detent recess when the door is in the intermediate position.

In another aspect of the present disclosure, an appliance is provided. The appliance may include a cabinet defining an opening, a basket, a door, a balance lever, and a counter balance assembly. The basket may be positioned within the cabinet and define a wash chamber beneath the opening of the cabinet. The door may define a pivot axis and be pivotally attached to the cabinet. The door may further be pivotable about the pivot axis between an open position and a closed position. The balance lever may be fixed to the door and extending in a radial direction away from the pivot axis to a distal end. The counter balance assembly may be mounted to the balance lever to hold the door in an intermediate position between the open position and the closed position. The counter balance assembly may include a guide pin coupled to the door between the balance lever, the guide pin being spaced apart from the pivot axis in the radial direction, and an engagement bracket rotatably disposed about the guide pin at the distal end of the balance lever. The engagement bracket may include a projection slidably disposed on the guide pin. The projection may extend radially inward from the engagement bracket to engage the guide pin when the door is in the intermediate position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
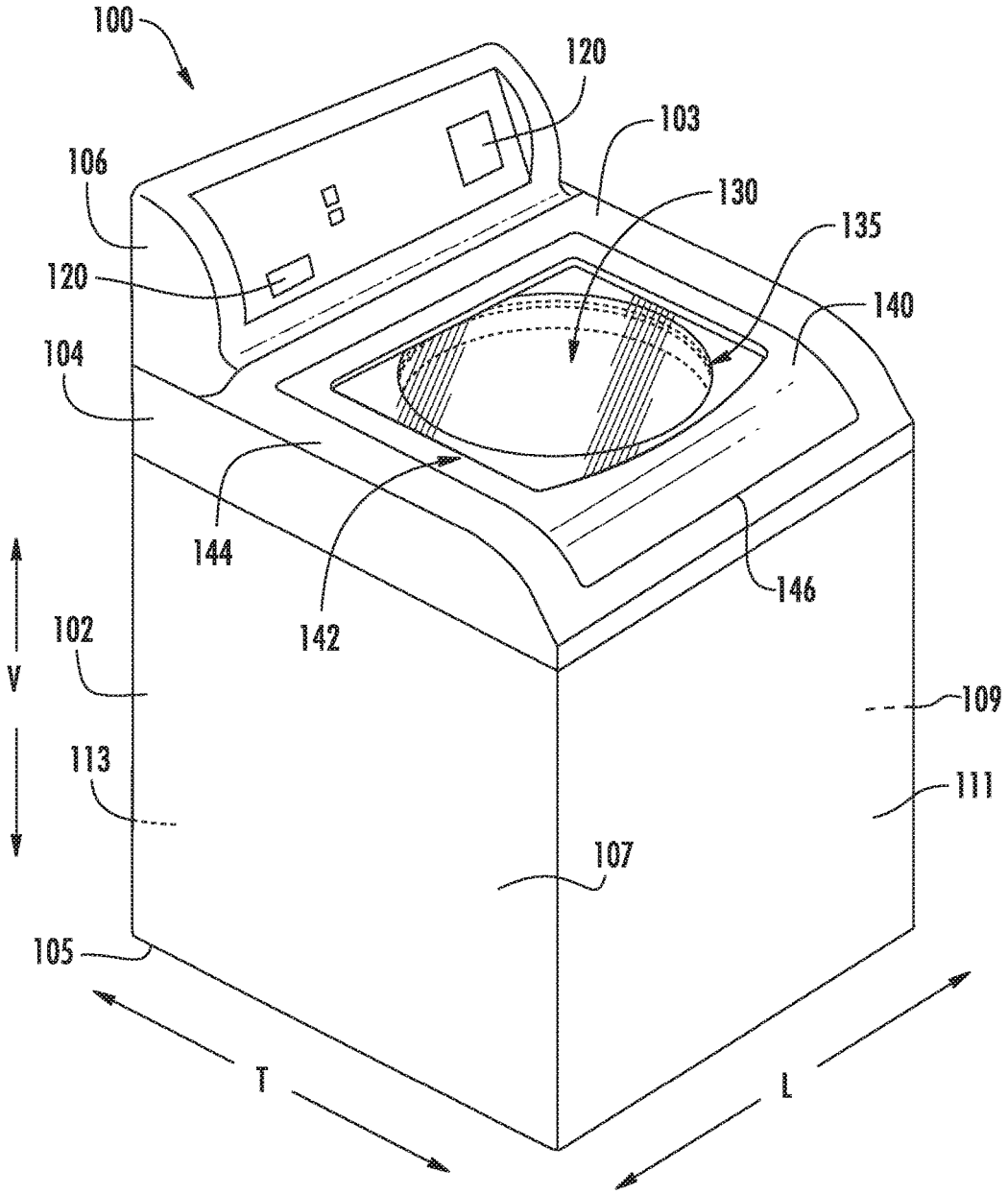
FIG. 1 provides a perspective view of a washing machine appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides a washing machine appliance that includes a lid assembly. The lid assembly has a door and may be configured to selectively stop the door at a closed position, an open position, and an intermediate position between the closed and open positions. The lid assembly may include a counter balance assembly that generally assists in opening the door. The counterbalance assembly may include a guide pin and trailing surface that assist in holding the door in the intermediate position.

FIG. 1 illustrates an exemplary embodiment of a vertical axis washing machine appliance 100. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well.

As may be seen in FIG. 1, washing machine appliance 100 has a cabinet 102 that defines a vertical direction V, a lateral direction L, and a transverse direction T. The vertical direction V, lateral direction L, and transverse direction T are all mutually perpendicular and form an orthogonal direction system. Generally, cabinet 102 extends between a top portion 103 and a bottom portion 105 along the vertical direction V. Cabinet 102 also extends between a first side portion 107 and a second side portion 109, e.g., along the lateral direction L, and a front portion 111 and a rear portion 113, e.g., along the transverse direction T.

Cabinet 102 of washing machine appliance 100 has a top cover 104 positioned at or adjacent top portion 103 of cabinet 102. Top cover 104 defines an opening 135 that permits user access to wash chamber 130 of wash basket 120 positioned below opening 135. A lid assembly that includes a door 140 is pivotally attached to top cover 104. However, alternatively, door 140 may be mounted to cabinet 102 or another suitable support. Door 140 selectively rotates between a closed position and an open position, as will be described in detail below. Generally, in the closed position, door 140 inhibits access to wash chamber 130. Conversely, in the open position, a user can access wash chamber 130. As illustrated, door 140 also includes a handle 146 that, e.g., a user may pull and/or lift when opening and closing door 140.

Door 140 includes a pivotable frame 144 that defines an aperture 308 above the wash chamber 130. A discrete panel 142 extends across the aperture 308 such that panel 142 is bounded by a portion of pivotable frame 144 and restricts access through door 140. In some embodiments, panel 142 is configured as a window. For instance, panel 140 may be embodied as a transparent plastic or glass pane. In such embodiments, panel 142 may permit viewing of wash chamber 130 when door 140 is in the closed position, e.g., during operation of washing machine appliance 100.

A backsplash 106 extends from cover 104. A variety of appliance control input selectors 120 are coupled to backsplash 106, e.g., to control operation of the appliance 100. Input selectors 102 can be of a touch type such as touchpad or may include more traditional knobs and dials. Regardless, input selectors 120 provide an interface whereby the user may operate the machine and select various operation features of the appliance. A display may also be provided on backsplash 106 for notifying the user of various aspect of the machine's operation including e.g., the mode of operation, water temperature selected, and other relevant information.

Washing machine 100 is controlled by a processing device or other controller, such as a microprocessor (not shown), according to user preference via manipulation of control input selectors 120 mounted on backsplash 106. As used herein, processing device may refer to one or more microprocessors or semiconductors devices and is not restricted necessarily to a single element. The processing device can be programmed to operate washing machine 100 according to features desired by the consumer.

Figure 2:
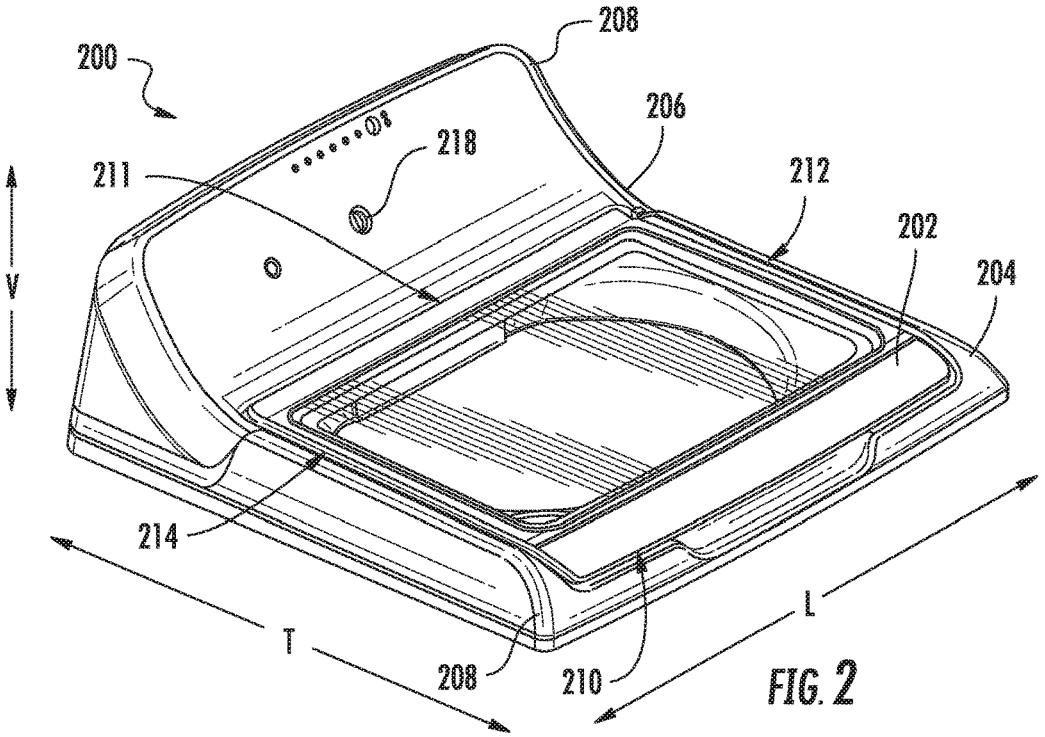
FIG. 2 provides a perspective view of the lid assembly of the exemplary washing machine appliance of FIG. 1, with the door being in a closed position.
Figure 3:
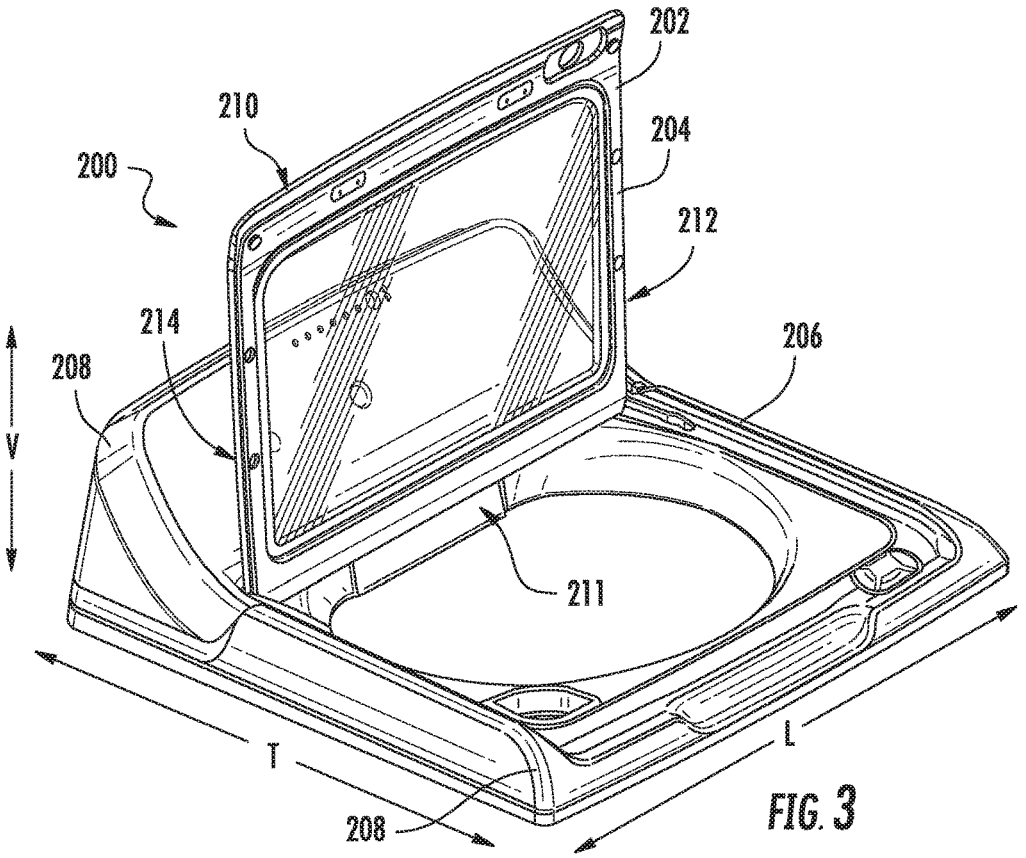
FIG. 3 provides a perspective view of the lid assembly of the exemplary washing machine appliance of FIG. 1, with the door being in an open position.
Figure 4:
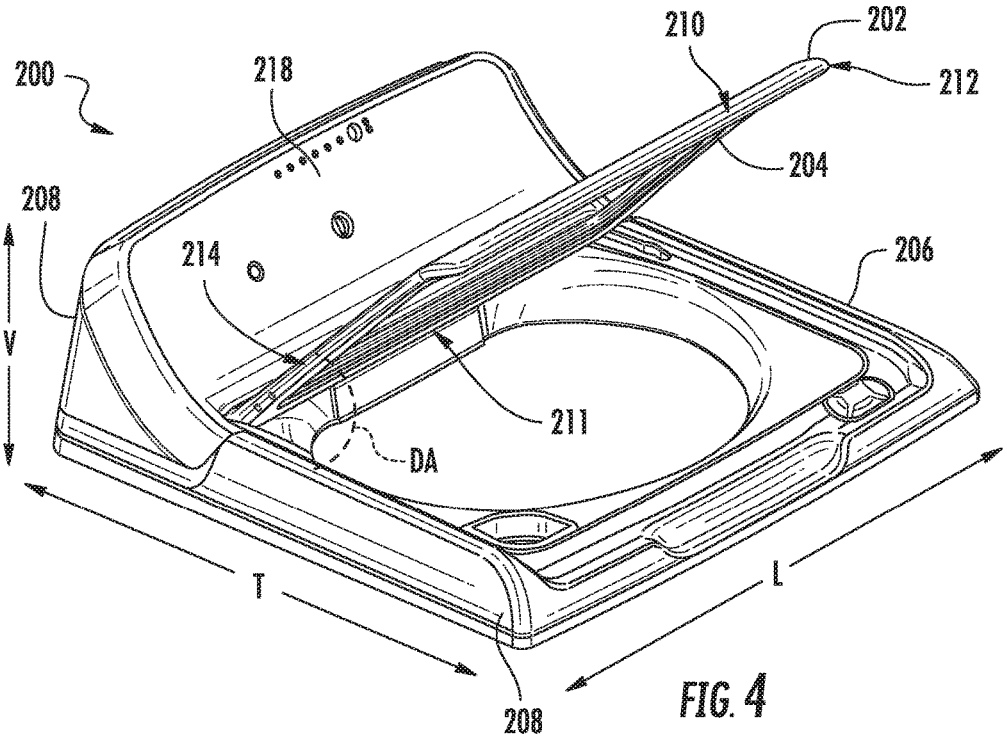
FIG. 4 provides a perspective view of the lid assembly of the exemplary washing machine appliance of FIG. 1, with the door being in an intermediate position.
Figure 5:
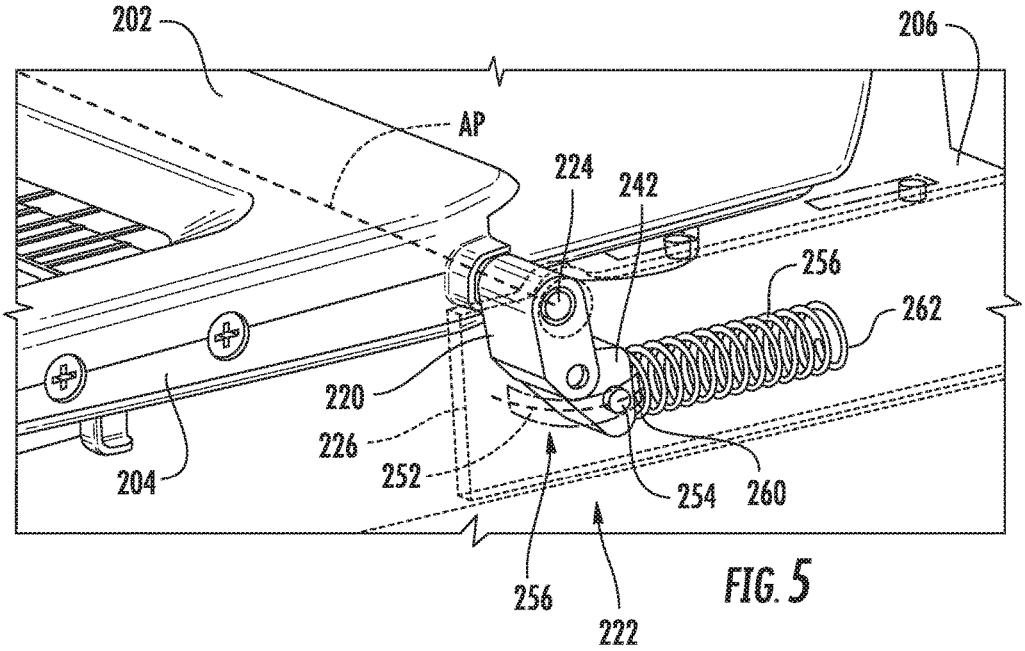
FIG. 5 provides a magnified perspective view of a portion of the lid assembly of exemplary washing machine appliance of FIG. 1, with the door being in a closed position.

Turning to FIGS. 2 through 4, an exemplary lid assembly 200 is illustrated. As shown, lid assembly 200 includes a door 202 having a pivotable frame 204 that is attached to a top cover 208 of a cabinet 206 and selectively movable between a plurality of positions. Door 202 may be formed as a generally flat body extending between a front end portion 210 and a rear end portion 211, as well as between a first lateral side portion 212 and a second lateral side portion 214. As it moves to each position, door 202 rotates about pivot axis AP (see FIG. 5) in front of a backsplash 216, e.g., at rear end portion 211. Generally, it is understood that backsplash 216, top cover 208, door 202, and pivotable frame 204, may be embodied as backsplash 106, top cover 104, door 140, and pivotable frame 144 illustrated in FIG. 1.

As illustrated, door 202 is selectively pivotable about a pivot axis (e.g., that is parallel to the lateral direction L) to a closed position (FIG. 2), an open position (FIG. 3), and an intermediate position (FIG. 4) that is between the closed and open positions. In the closed position of FIG. 3, door 202 extends across an opening 135 (see FIG. 1) defined by top cover 208. Door 202 may rest against top cover 208 in a horizontal orientation, e.g., in a plane substantially parallel to the transverse direction T or orthogonal to the vertical direction V. Door 202 may restrict access to wash chamber 130 (see FIG. 1), such that any articles (such as clothes to be washed) cannot be added to or removed from wash chamber 130 when door 202 is in the closed position. In the open position of FIG. 3, door 202 extends above top cover 208, e.g., in a generally vertical direction V. Access to the wash chamber 130 may be substantially unimpeded. However, in the open position, the door 202 may substantially block backsplash 216 and a corresponding user interface 218, e.g., in the transverse direction T. In the intermediate position of FIG. 4, door 202 is generally held at a position between the closed position of FIG. 2 and the open position of FIG. 3. Door 202 may permit some access to wash chamber 130 (see FIG. 1) through opening 135. Nonetheless, at least a portion of door 202 may extend over or across opening 135. In the intermediate position, door 202 may form a predetermined angle DA with the transverse direction T, e.g., at or along pivotable frame 204 in a plane that is perpendicular to the lateral direction L. For instance, the predetermined angle DA may be between thirty degrees (30°) and sixty degrees (60°) relative to the transverse direction T. In certain embodiments, the predetermined angle DA is about forty-five degrees (45°) relative to the transverse direction T. As used herein, the term "about" means within five degrees of the stated angle when used in the context of angles. Such orienting of door 202 in the intermediate positioned may facilitate access to both wash chamber 130 and user interface 218 on backsplash 216.

Turning to FIGS. 5 through 12, several magnified views of various components of lid assembly 200 are provided. As illustrated, lid assembly 200 generally includes a balance lever 220 and a counter balance assembly 222. Balance lever 220 and counter balance assembly 222 may be attached to door 202, as well as to each other. Balance lever 220 and counter balance assembly 222 may be configured to assist movement of door 202, e.g., away from the closed position. In some such embodiments, door 202 opening and/or closing motions of the door 202 (e.g., a pivoting motion out of or toward closed position, respectively), may be influenced or motivated by balance lever 220 and/or counter balance assembly 222. Although only shown at a single lateral side portion 212 of door 202, it is understood that optional embodiments will include a similar balance lever 220 and/or counter balance assembly 222 at the opposite lateral side portion 214.

In some embodiments, a pivot rod 224 extends from pivotable frame 204, e.g., perpendicularly or along a pivot axis AP. Pivot rod 224 may be fixed to pivotable frame 204 to rotate about pivot axis AP with pivotable frame 204. Optionally, a pivot rod 224 may be provided at each lateral side portion 212, 214 of pivotable frame 204. Multiple discrete rods may be provided or a single rod may extend between both lateral side portions 212, 214.

As illustrated, exemplary embodiments of balance lever 220 are fixed to pivot rod 224. Balance lever 220 may extend from pivot rod 224 and/or pivot axis AP, e.g., in a generally radial direction R, to a distal end portion 228. When assembled, balance lever 220 may be positioned between pivotable frame 204 and top cover 208 in the lateral direction L. A static support bracket 226 coupled to cabinet 206 may bound balance lever 220 on one lateral side while pivotable frame 204 bounds balance lever 220 on the opposite lateral side. One or more lever apertures 230 may be defined through the balance lever 220. For instance, lever aperture(s) 230 may be defined along the lateral direction L. Moreover, lever aperture(s) 230 may be defined at a location that is radially spaced from the pivot axis AP, e.g., at the distal end portion 228 of balance lever 220. As shown, balance lever 220 may be fixed to pivot rod 224 at an angle, e.g., an angle that is not parallel relative to the vertical direction V.

In some embodiments, a counter balance assembly 222 is mounted to the balance lever 220. Counter balance assembly 222 may include a discrete guide pin 232, engagement bracket 242, and/or static bracket 226. Optionally, counter balance assembly 222 may be mounted to cabinet 206, e.g., at a static bracket 226 that is fixed to the top cover 208. In some such embodiments, counter balance assembly 222 operably connects or couples balance lever 220 to static bracket 226. Counter balance assembly 222 is operably positioned between balance lever 220 and cabinet 206. For instance, in exemplary embodiments, the counter balance assembly 222 is coupled to the distal end portion 228 of balance lever 220. A guide pin 232 may be coupled to the door 202 through the balance lever 220. Moreover, guide pin 232 may be coupled at a position operably between balance lever 220 and cabinet 206, e.g., at static bracket 226 such that motion at the balance lever 220 may be at least partially transferred to guide pin 232. In certain embodiments, guide pin 232 is spaced apart from the pivot axis AP in the radial direction R. In some such embodiments, guide pin 232 is disposed through lever aperture 230. Guide pin 232 may be fixed relative to balance lever 220 (e.g., via brazing, welding, adhesion, etc.) such that movement of balance lever 220 is directly followed by guide pin 232.

As illustrated, guide pin 232 may be formed in a generally cylindrical shape. When assembled, a generally circular profile 234 extends in the lateral direction L through balance lever 220 and engagement bracket 242. The generally circular profile 234 may possess an arcuate shape extending along a circumferential direction C about a centerpoint CP. However, one or more features may disrupt an otherwise consistent radius from centerpoint CP. In some such embodiments, guide pin 232 includes a cam tooth 236. As illustrated, cam tooth 236 may extend radially from a centerpoint CP of the generally circular profile 234 of guide pin 232. Cam tooth 236 may be a raised ridge extending above the portions of the generally circular profile 234 that are immediately adjacent thereto, e.g., adjacent in the circumferential direction C. For instance, in optional embodiments, guide pin 232 defines one or more notches 238, 240 adjacent to cam tooth 236 in the circumferential direction C. Guide pin 232 may define a first radial notch 238 and a second radial notch 240 along the generally circular profile 234. In certain embodiments, the first radial notch 238 and second radial notch 240 are defined on opposite circumferential sides of cam tooth 236.

As noted above, some embodiments include an engagement bracket 242 that is connected to guide pin 232. In the illustrated embodiments of FIGS. 5 through 12, engagement bracket 242 is rotatably disposed about guide pin 232. A trailing surface 244 is formed on engagement bracket 242 and defines a lateral void that generally complements the shape of guide pin 232. As illustrated, trailing surface 244 may be operably disposed between balance lever 220 and cabinet 206, e.g., such that movement at balance lever 220 is at least partially transferred to trailing surface 244. During movement of door 202, trailing surface 244 may slide along the general circular profile 234 of guide pin 232, as will be described in detail below. In exemplary embodiments, trailing surface 244 includes one or more projections 246, 248 that extend radially inward, e.g., toward guide pin 232. In optional embodiments, a first projection 246 and a second projection 248 are included. Each first projection 246, 248 may be spaced apart from the other 248, 246, e.g., in the circumferential direction C. Together, the projections 246, 248 may define a detent recess 250 therebetween. In some such embodiments, detent recess 250 is complementary to cam tooth 236. Detent recess 250 is formed to selectively receive cam tooth 236 between the first and second projections 246, 248 and hold guide pin 232 at one or more predetermined positions. Although shown on the engagement bracket 242, it is noted that alternative embodiments may define the described trailing surface 244 and/or cam tooth 236 along another member, such as along a pin/slot through a static bracket 226 that is fixed relative to cabinet 206.

In certain embodiments, engagement bracket 242 slidably engages cabinet 206 along a discrete bracket path 252. For instance, one or more tabs 254 may be inserted through one or more respective slots 256 to an operable position between engagement bracket 242 and static bracket 226, e.g., such that motion at the engagement bracket 242 is at least partially transferred to tabs 254. In some such embodiments, engagement bracket 242 includes a tab 254 that extends in the lateral direction L while static bracket 226 defines an arcuate slot 256 along the bracket path 252. Tab 254 may extend into slot 256 in the lateral direction L. When assembled, tab 254 is slidably received within slot 256. As door 202 is moved between the closed, intermediate, and open positions, tab 254 may generally slide within tab 254 as engagement bracket 242 is guided along the bracket path 252.

In some embodiments, a resilient biasing member 258 may be provided at the engagement bracket 242. Resilient biasing member 258 may be attached to engagement bracket 242 to motivate or urge door 202 into one or more positions. For instance, resilient biasing member 258 may provide a substantially linear force to engagement bracket 242, e.g., in the transverse direction T. Through the engagement bracket 242, the force may be transmitted to balance lever 220 such that door 202 is biased to rotate toward the open position. The force provided by the resilient biasing member 258 alone may be insufficient to lift the door 202 from the closed position (e.g., overcome the weight and moment of door 202) but sufficient to assist upward rotation away from the closed position. Additionally or alternatively, the force provided by the resilient biasing member 258 may be sufficient to resist downward rotation of door 202 toward the closed position.

In optional exemplary embodiments, the resilient biasing member 258 is a compression member, such as a compression spring or pneumatic strut. Resilient biasing member 258 may extend between the engagement bracket 242 and the cabinet 206. In an exemplary embodiments, resilient biasing member 258 extends from a first end portion 260 to a second end portion 262, e.g., in the transverse direction T. In some such embodiments, resilient biasing member 258 is attached to engagement bracket 242 at first end portion 260, while second end portion 262 extends toward a fixed rear portion (not pictured) of cabinet 206. When assembled, second end portion 262 may be fixed in the transverse direction T and/or relative to cabinet 206, while first end portion 260 is permitted to travel with engagement bracket 242, e.g., along the bracket path 252.

Figure 8:
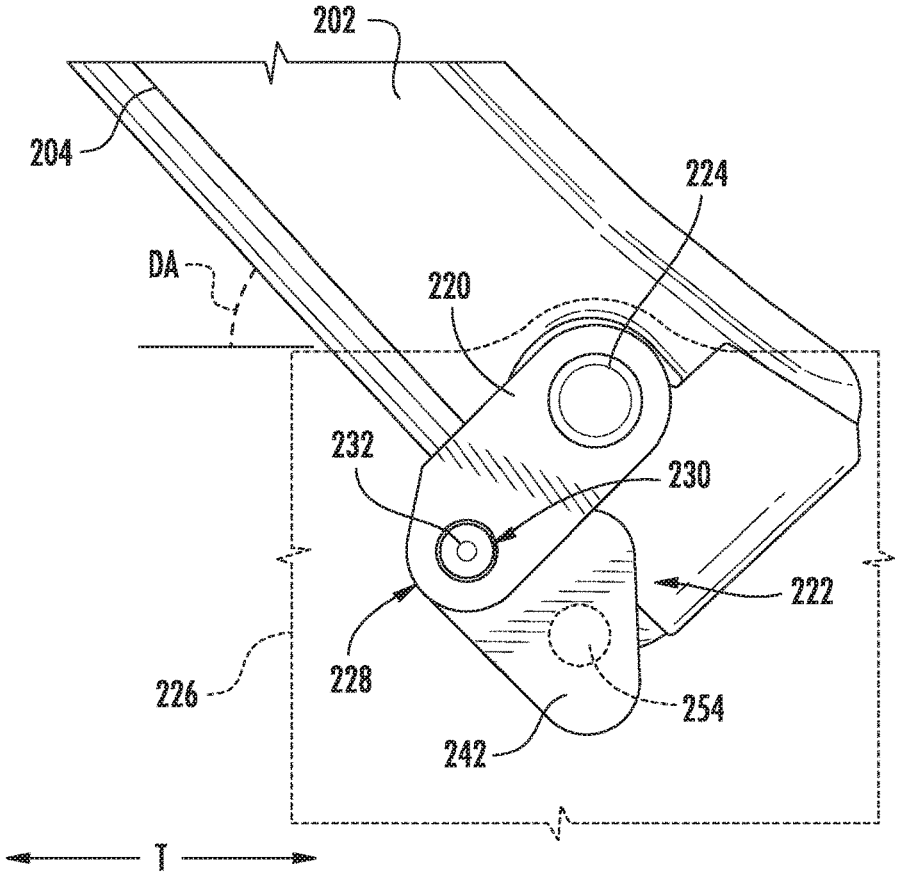
FIG. 8 provides a magnified side view of a portion of the lid assembly of exemplary washing machine appliance of FIG. 1, with the door being in an intermediate position.
Figure 9:
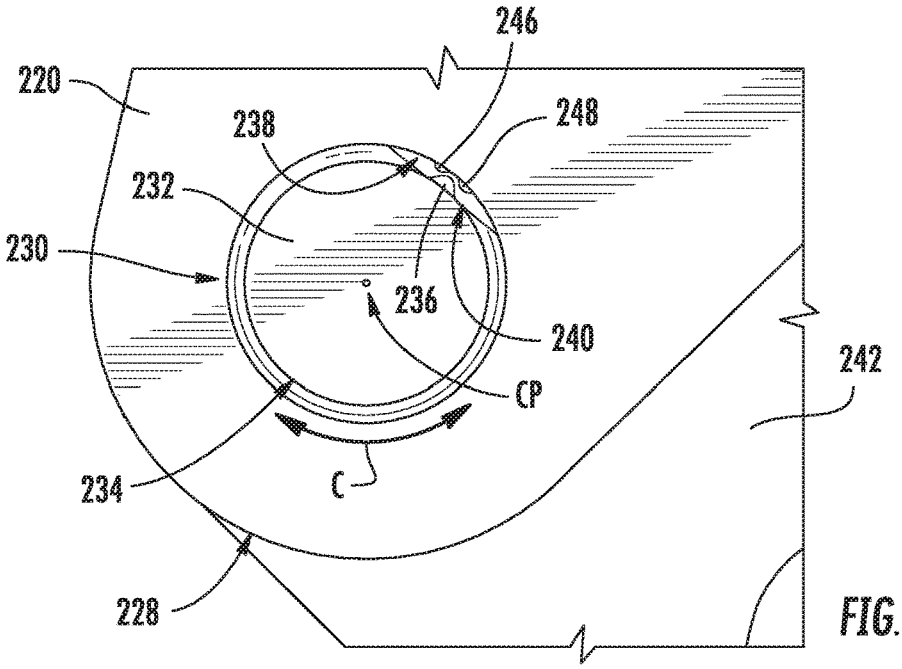
FIG. 9 provides a further magnified view of a portion of the lid assembly of the exemplary embodiment of FIG. 8.
Figure 10:
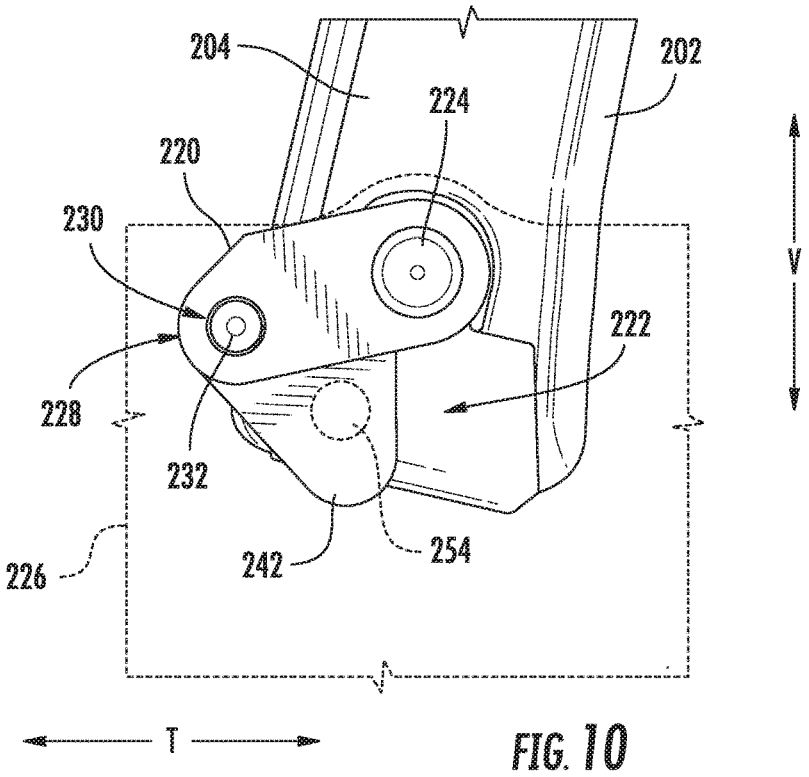
FIG. 10 provides a magnified side view of a portion of the lid assembly of exemplary washing machine appliance of FIG. 1, with the door being in an open position.
Figure 11:
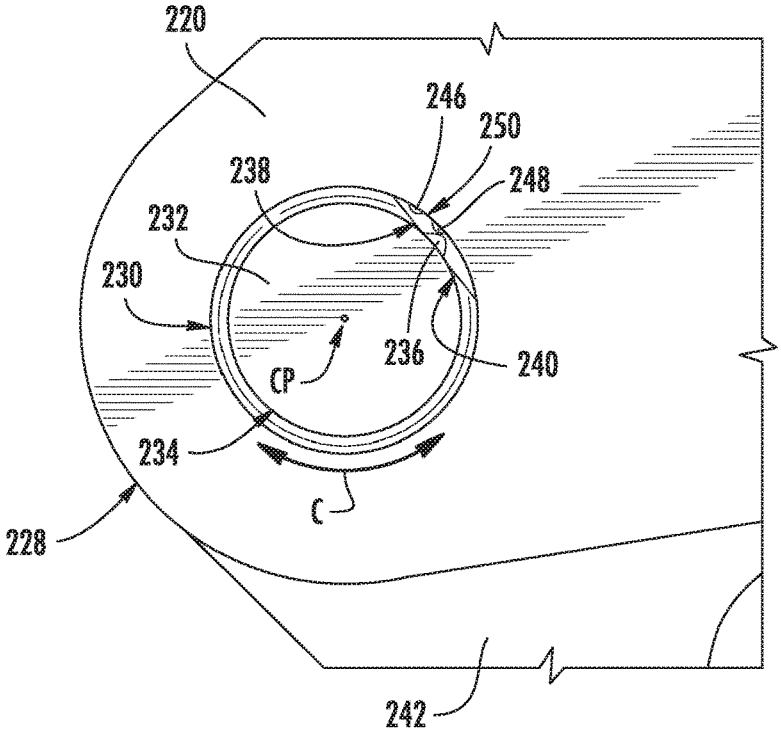
FIG. 11 provides a further magnified view of a portion of the lid assembly of the exemplary embodiment of FIG. 10.
Figure 12:
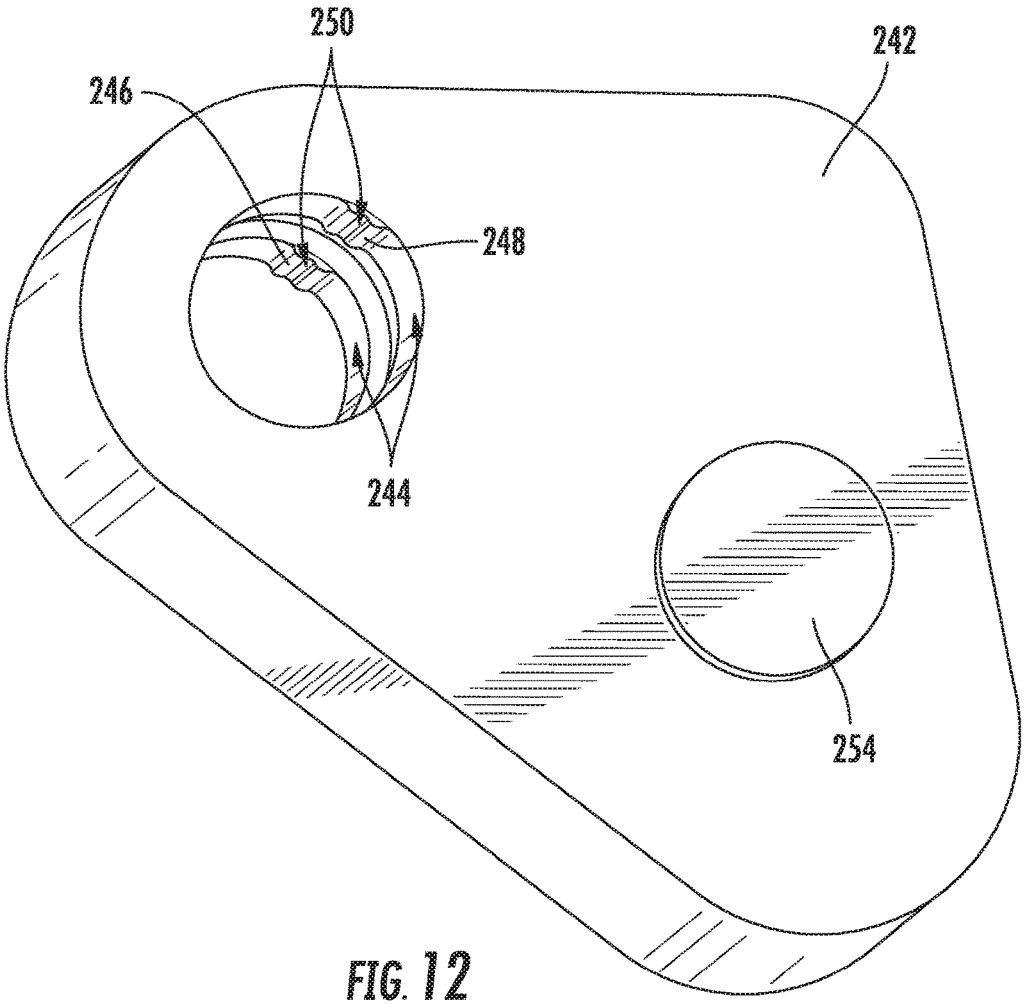
FIG. 12 provides a perspective view of an engagement bracket of the exemplary embodiments of FIGS. 5 through 11.

Turning to FIGS. 6 through 11, magnified views various portions of lid assembly 200 (e.g., door 202, balance lever 220, and engagement bracket 242) are provided to illustrate an exemplary embodiment at a closed position (FIGS. 6 and 7), an intermediate position (FIGS. 8 and 9), and an open position (FIGS. 10 and 11). Door 202 may be pivoted to each position. Moreover, at each position, lid assembly 200 may be substantially self-supported, e.g., such that user is not required to provide any support to hold door 202 at the respective position.

Figure 6:
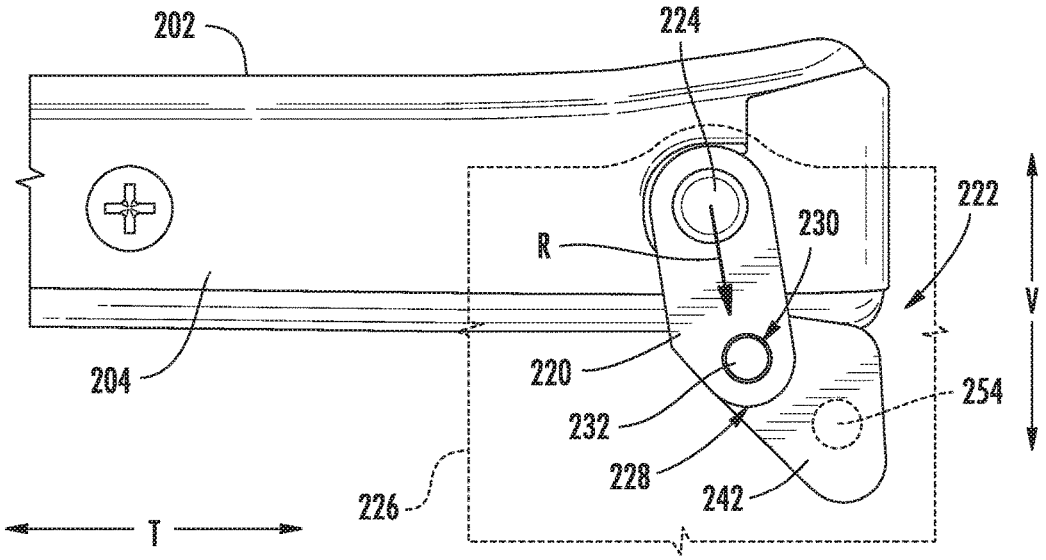
FIG. 6 provides a magnified side view of a portion of the lid assembly of exemplary washing machine appliance of FIG. 1, with the door being in a closed position.
Figure 7:
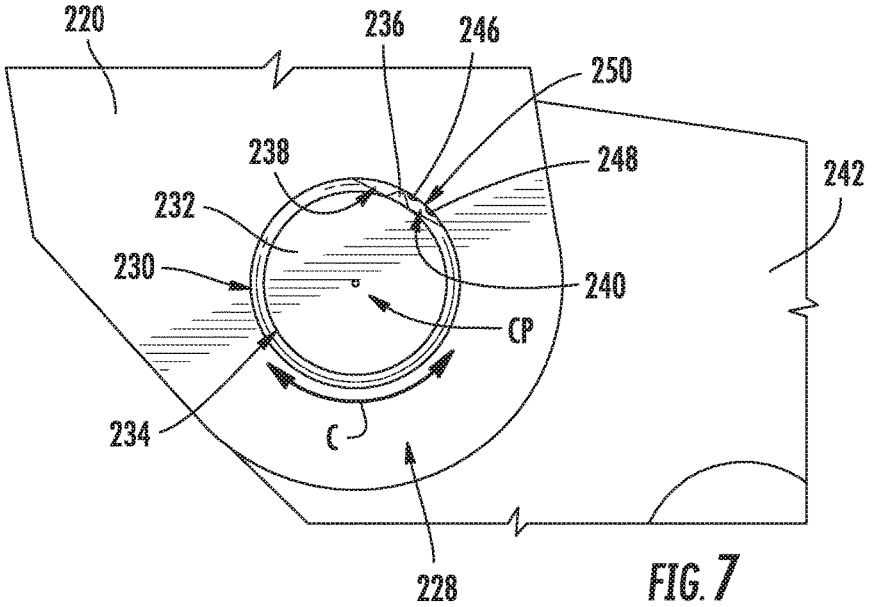
FIG. 7 provides a further magnified view of a portion of the lid assembly of the exemplary embodiment of FIG. 6.

As illustrated in FIGS. 6 and 7, the closed position may provide door 202 at substantially horizontal position, e.g., such that a bottom portion of pivotable frame 204 is positioned on top cover 208. In optional exemplary embodiments, one or more of the projections 246, 248 of trailing surface 244 are positioned within the second radial notch 240. For instance, second radial notch 240 may receive both the first projection 246 and the second projection 248. In the closed position, cam tooth 236 may be positioned above the projections 246, 248 adjacent to first projection 246.

As illustrated in FIGS. 8 and 9, and as noted above, the intermediate position may provide door 202 at an inclined angle, e.g., at a predetermined angle DA having an absolute value greater than zero degrees (0°) relative to the transverse direction T. For instance, the predetermined angle DA may be between thirty degrees (30°) and sixty degrees (60°) relative to the transverse direction T. In certain embodiments, the predetermined angle DA is about forty five degrees (45°) relative to the transverse direction T. In optional exemplary embodiments, one or more of the projections 246, 248 of trailing surface 244 are positioned within the first radial notch 238 and the second radial notch 240 while door 202 is in the intermediate position. First radial notch 238 may receive the first projection 246 while the second radial notch 240 receives the second projection 248. Cam tooth 236 may rest within detent recess 250 between first projection 246 and second projection 248. Second radial notch 240 may receive both the first projection 246 and the second projection 248. Cam tooth 236 may be positioned above the projections 246, 248 adjacent to first projection 246. Friction or interference between cam tooth 236 and trailing surface 244, e.g., at the first projection 246, may support door 202 and hinder movement at the distal end portion 228 of balance lever 220. However, the engagement between guide pin 232 and trailing surface 244 may be overcome in response to sufficient force provided at the door 202. Resilient deformation at cam tooth 236 and/or projections 246, 248 may permit cam tooth 236 to rotate away from or out of detent recess 250.

As illustrated in FIGS. 10 and 11, the open position may provide door 202 at an increased angle, e.g., an angle greater than the predetermined angle of the intermediate position. For instance, the increased angle of the open position may be greater than sixty degrees (60°) relative to the transverse direction T and/or closed position. Optionally, the increased angle may be between ninety degrees (90°) and one hundred twenty-five degrees (125°), such as about one hundred ten degrees (110°). In optional embodiments, one or more of the projections 246, 248 of trailing surface 244 are positioned within the first radial notch 238. For instance, first radial notch 238 may receive both the first projection 246 and the second projection 248. Cam tooth 236 may be positioned below the projections 246, 248 adjacent to second projection 248.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:
a cabinet defining an opening;
a basket positioned within the cabinet, the basket defining a wash chamber beneath the opening of the cabinet;
a door defining a pivot axis, the door being pivotally attached to the cabinet, the door being pivotable about the pivot axis between an open position and a closed position;
a balance lever fixed to the door and extending in a radial direction away from the pivot axis to a distal end; and
a counter balance assembly mounted to the balance lever to hold the door in an intermediate position between the open position and the closed position, the counter balance assembly including
a guide pin coupled to the balance lever, the guide pin being spaced apart from the pivot axis in the radial direction, and
a bracket coupled to the cabinet and defining a trailing surface, the guide pin rotatably disposed about the bracket and slidably disposed on the trailing surface of the bracket, the trailing surface including a first projection and a second projection spaced apart from the first projection to define a detent recess therebetween, the guide pin received within the detent recess when the door is in the intermediate position.

2. The appliance of claim 1, wherein the guide pin is fixed to the balance lever at the distal end of the balance lever.

3. The appliance of claim 1, wherein the door defines an angle between thirty degrees and sixty degrees relative to a transverse direction that is perpendicular to a vertical direction when the door is in the intermediate position.

4. The appliance of claim 3, further comprising a resilient biasing member extending between the bracket and the cabinet to bias the door toward the open position.

5. The appliance of claim 1, wherein the door includes a pivot rod extending along the pivot axis, and wherein the balance lever is fixed relative to the pivot rod.

6. The appliance of claim 1, wherein the bracket is an engagement bracket rotatably disposed about the guide pin at the distal end of the balance lever, and wherein the trailing surface formed on the engagement bracket.

7. The appliance of claim 6, further comprising:
a static bracket fixed to the cabinet and defining a discrete bracket path, wherein the engagement bracket slidably engages the static bracket along the discrete bracket path.

8. The appliance of claim 7, wherein the engagement bracket includes a tab extending in a lateral direction that is perpendicular to a vertical direction, and wherein the static bracket defines a slot that slidably receives the tab.

9. The appliance of claim 1, wherein the guide pin includes a cam tooth slidably disposed on the trailing surface of the bracket.

10. The appliance of claim 9, wherein the cam tooth is complementary to the detent recess such that the cam tooth selectively rest within the detent recess at the intermediate position of the door.

11. The appliance of claim 1, wherein the guide pin defines a first radial notch and a second radial notch, wherein the first radial notch receives the first projection in the closed position, and wherein the second radial notch receives the second projection in the closed position.

12. An appliance comprising:
a cabinet defining an opening;
a basket positioned within the cabinet, the basket defining a wash chamber beneath the opening of the cabinet;
a door defining a pivot axis, the door being pivotally attached to the cabinet, the door being pivotable about the pivot axis between an open position and a closed position;
a balance lever fixed to the door and extending in a radial direction away from the pivot axis to a distal end; and
a counter balance assembly mounted to the balance lever to hold the door in an intermediate position between the open position and the closed position, the counter balance assembly including
a guide pin coupled to the door through the balance lever, the guide pin being spaced apart from the pivot axis in the radial direction, and
an engagement bracket rotatably disposed about the guide pin at the distal end of the balance lever, the engagement bracket including a projection slidably disposed on the guide pin, the projection extending radially inward from the engagement bracket to engage the guide pin when the door is in the intermediate position.

13. The appliance of claim 12, wherein the guide pin is fixed to the balance lever at the distal end of the balance lever.

14. The appliance of claim 12, wherein the door defines an angle between thirty degrees and sixty degrees relative to a transverse direction that is perpendicular to a vertical direction when the door is in the intermediate position.

15. The appliance of claim 14, further comprising a resilient biasing member extending between the engagement bracket and the cabinet to urge the door toward the open position.

16. The appliance of claim 12, wherein the door includes a pivot rod extending along the pivot axis, and wherein the balance lever is fixed relative to the pivot rod.

17. The appliance of claim 12, further comprising:
a static bracket fixed to the cabinet and defining a discrete bracket path, wherein the engagement bracket slidably engages the static bracket along the discrete bracket path.

18. The appliance of claim 17, wherein the engagement bracket includes a tab extending in a lateral direction that is perpendicular to a vertical direction, and wherein the static bracket defines a slot that slidably receives the tab.

19. The appliance of claim 12, wherein the guide pin includes a cam tooth slidably disposed on the trailing surface of the engagement bracket.

20. The appliance of claim 12, wherein the guide pin defines a radial notch that receives the projection in the closed position.

* * * * *